United States Patent [19]

Sallee

[11] Patent Number: 4,763,127

[45] Date of Patent: Aug. 9, 1988

[54] FIBER UNDER FOIL CHAFF COIL

[75] Inventor: Bradley T. Sallee, Austin, Tex.

[73] Assignee: Tracor Aerospace Austin, Inc., Austin, Tex.

[21] Appl. No.: 822,127

[22] Filed: Jan. 24, 1986

[51] Int. Cl.[4] ..... F42B 13/28

[52] U.S. Cl. ..... 342/12; 102/505

[58] Field of Search ..... 342/12; 102/504, 505

[56] References Cited

U.S. PATENT DOCUMENTS

| | | | |
|---|---|---|---|
| 2,489,337 | 11/1949 | Sperling | 342/12 |
| 3,863,254 | 1/1975 | Turner | 342/12 |
| 3,910,189 | 10/1975 | Whidden et al. | 342/12 |
| 4,404,912 | 9/1983 | Sinderman | 342/12 |
| 4,435,481 | 3/1984 | Baldi | 342/12 |
| 4,440,793 | 5/1984 | Gibbs | 342/12 |

*Primary Examiner*—Thomas H. Tarcza
*Assistant Examiner*—Mark Hellner
*Attorney, Agent, or Firm*—Arnold, White & Durkee

[57] ABSTRACT

A chaff device for exoatmospheric deployment as a countermeasure to radar detection of exoatmospheric objects utilizes a plurality of elongated foil members and a plurality of elongated fiber members, each for providing a dipole. The foil dipole members are disposed in an end-to-end overlapping relationship and wrapped in a coil configuration. The fiber dipole members in a group are disposed adjacent one of the foil dipole members so as to be sandwiched between adjacent layers of coil wrapped foil dipole members.

7 Claims, 2 Drawing Sheets

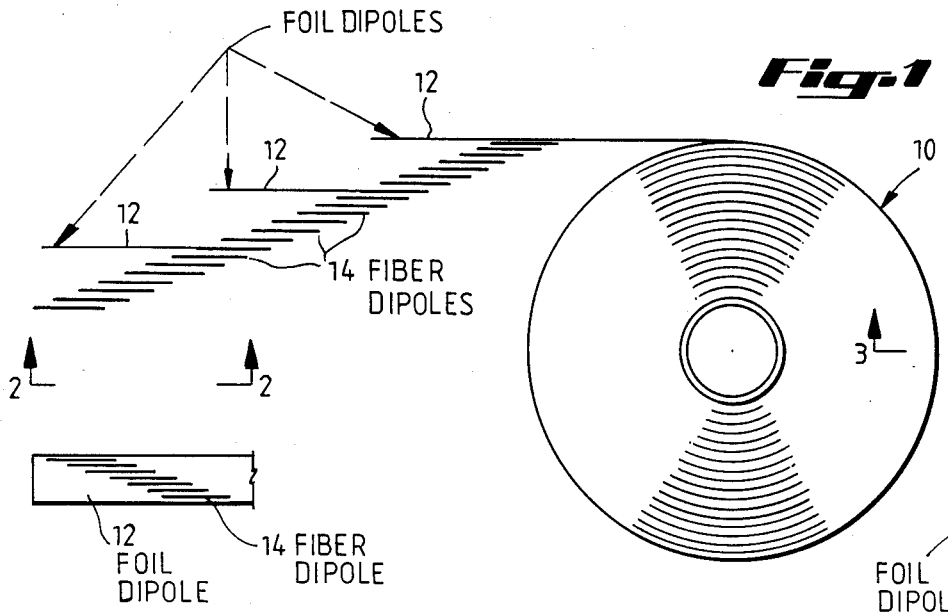
Fig. 1
Fig. 2
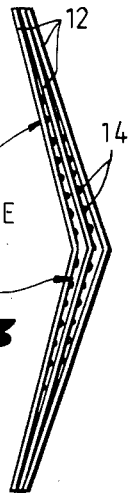
Fig. 3
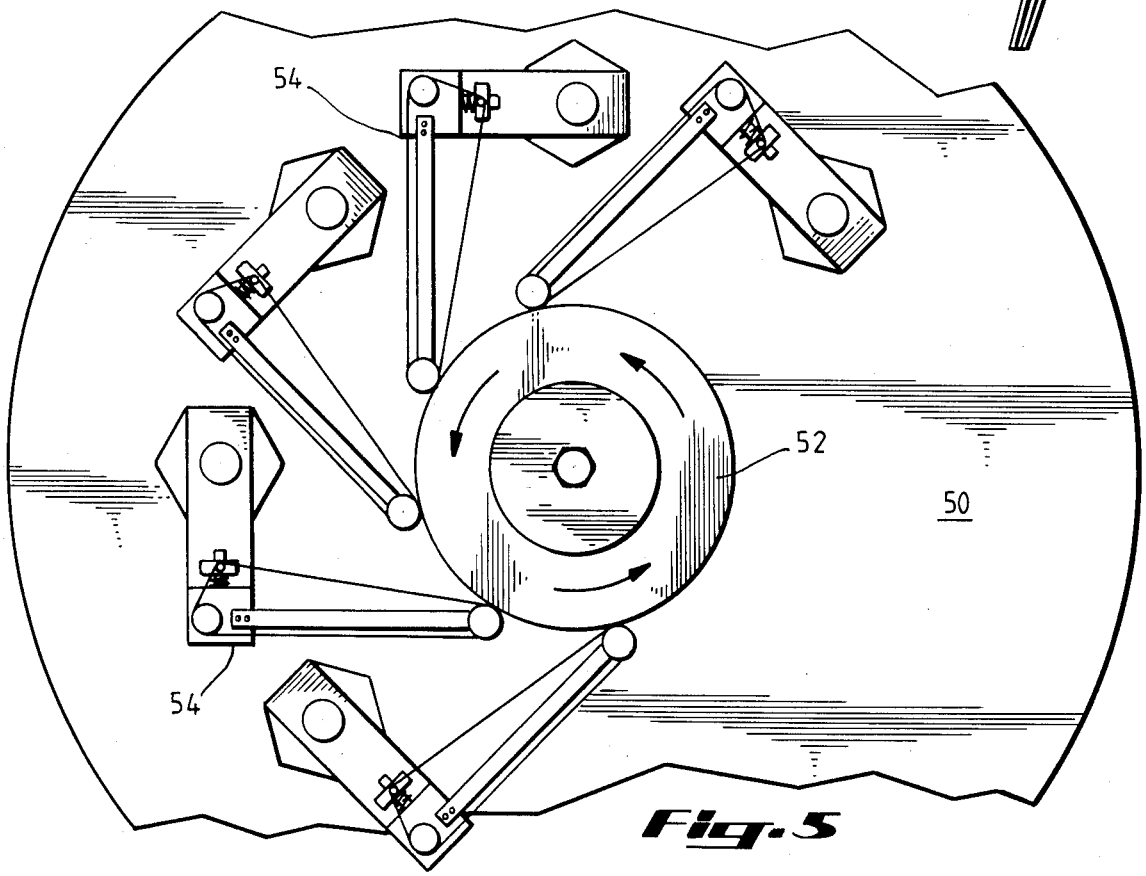
Fig. 5

FIBER UNDER FOIL CHAFF COIL

BACKGROUND OF THE INVENTION

The present invention relates to countermeasures to radar detection of exoatmospheric objects, such as aircraft or missles in flight, and more particularly, it relates to countermeasures for exoatmospheric deployment of chaff.

Countermeasures to confuse radar detection warning systems have long been in use. One countermeasure technique has been the deploying of dipoles in a cloud. Difficulty has been encountered, however, in extending the cloud of dipoles concept to exoatmospheric missile system because there is no gravity or air to aid deployment. Techniques for exoatmospheric dipole deployment have included the use of low vapor pressure liquids and solids to dispense rod dipoles. This resulted in high cloud growth rates. The weight of the chaff to produce a chaff cloud sufficient to confuse a radar is proportional to the growth rate cubed. The "growth rate" refers to the velocity at which the dipoles leave the dispensing center. Thus, the high growth rates lead to very heavy systems.

Another technique for exoatmospheric dipole deployment involves the use of a foil coil which uses thin foil dipoles. The dipoles are wound around a coiling ring by placing the tip of one under the tail of the adjacent one. This dispersion technique relies upon the spring energy in the foil dipoles. Such a chaff has lower growth rates. This type of dipole depolyment scheme has heretofore been in general use in missile countermeasures.

SUMMARY OF THE INVENTION

The present invention provides a chaff device for deployment under vacuum, zero gravity (i.e., exoatmospheric) conditions to dispense dipoles for the purpose of radar confusion.

In accordance with the invention, a plurality of elongated foil members, each for providing a dipole, are disposed in an end-to-end overlapping relationship and wrapped in a coil configuration. A plurality of elongated fiber members, each for providing a dipole, are separated into a plurality of groups and each group disposed adjacent one of the foil dipole members so as to be sandwiched between adjacent layers of coil-wrapped foil dipole members.

The fiber dipoles in a group are significantly smaller than the foil dipole member width and are spaced out singly or in tufts along the width of the foil dipole. Further, the fiber dipoles are staggered relative to each other. The fiber dipoles are of a brittle material but flexible enough to be wrapped with the foil members without fracturing.

The spring energy in the foil dipole members and the collisions of the foil dipole members with fiber dipoles during deployment disperse the fiber dipoles individually (i.e., non-clumped) at a low velocity relative to the deployment center.

The dipoles are of a predetermined length so as to be "tuned" to the radar frequencies to be confused.

BRIEF DESCRIPTION OF THE DRAWINGS

A written description setting forth the best mode presently known for carrying out the present invention, and of the manner of implementing it, is provided by the following detailed description of the preferred embodiment which is illustrated in the attached drawings wherein:

FIG. 1 is a diagrammatic representation of the fiber under foil chaff coil of the present invention;

FIG. 2 is a view of the underside of one of the foil dipoles showing the arrangement thereof of the fiber dipoles;

FIG. 3 is a side view of a cross-section of a portion of the coil showing the configuration of the foil dipoles and the arrangement of the fiber dipoles between adjacent foil dipoles;

FIG. 5 is a diagram of the spool assembly wrapping spindle portion of the machine of FIG. 4.

DETAILED DESCRIPTION OF THE PREFERRED EMBODIMENT

Figure 4:
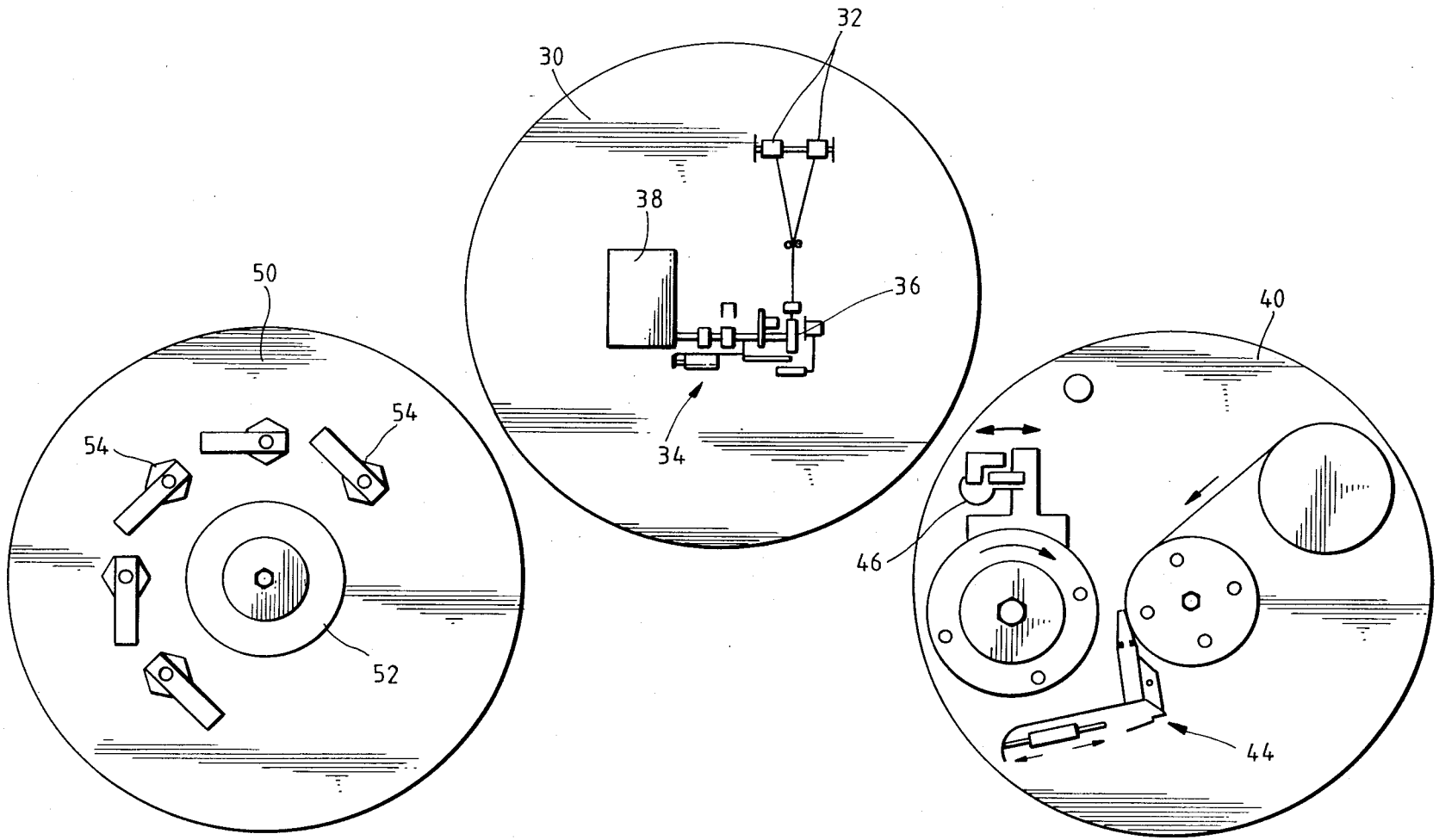
FIG. 4 is a diagram of the spool assembly wrapping machine for making the chaff coil of FIG. 1.

Referring to FIG. 1, there is shown a diagram of a chaff device in accordance with the present invention. As shown in FIG. 1, a plurality of foil members, each providing a dipole, are wrapped in a coil configuration to form the chaff device 10. The elongated foil members are generally designated by the reference numeral 12. The foil members are shown as being disposed in an end-to-end overlapping relationship and wrapped in a coil configuration. The chaff device further includes a plurality of elongated fiber members, each for providing a dipole. The fiber dipole members are separated into a plurality of groups. Each group of fiber dipole members is disposed adjacent one of the foil dipole members so as to be sandwiched between adjacent layers of coil-wrapped foil dipole members.

As further illustrated in FIG. 2, the foil dipole members have length and width dimensions greater than the length and width dimensions of the fiber dipole members. The fiber dipole members are approximately 1/40 to 1/80 the foil member width. Further, the fiber dipole members of each group are placed in parallel and laterally spaced-apart from one another. Also, the fiber dipole members of each group are in a longitudinal-stagger placement.

As shown in FIG. 3, which is a cross-section of a portion of coil chaff device 10, the foil dipole members are longitudinally crimped. Crimping provides enhanced stiffness of the members. As further shown in FIG. 3, the fiber dipole members 14 are sandwiched between the foil dipole members.

Both the fiber and foil dipole members are cut to the desired tuned dipole length. The foil dipole members are suitably of titanium and are about 0.0003 to 0.0005 inch in thickness. The fiber dipole members may be aluminized glass, glass covered copper, or nickel covered-copper covered glass. The fiber dipoles are suitably a rod-shaped geometry and comprise a single fiber strand per dipole. The fiber dipoles have a suitable conductivity and be brittle enough to cleanly fracture if bent over the edge of a foil dipole.

In general, the assembly of a fiber under foil chaff coil 10 involves the initial steps of foil preparation and fiber preparation. The foil preparation involves pre-crimpping the foil dipole members with a longitudinal crimp. The fiber dipole members are assembled into groups of up to eight dipoles each. The foil and fiber members are, of course, cut to a predetermined tuned dipole length. The assembly of the coil 10 takes place as a repeated procedure until the coil is the correct diameter. The procedure involves wrapping a foil dipole member on a coiling ring to start the coil. Thereafter, another foil dipole member is inserted under the end of the first dipole member. A group of fiber dipole members is inserted under the foil dipole member in the center of the crimp. The coil is rotated to trap the fibers. Then, another foil dipole member is inserted under the end of the second foil dipole member, and again a group of fiber dipole members is inserted under the third foil dipole member. The sequence of steps continues until the desired coil diameter is attained. Typically, approximately 1,200 foil dipole members are used. More than one group of fiber dipoles may be placed adjacent a single foil dipole member. Typically in such an assembly, up to 15,000 groups are used. Accordingly, something on the order of 4 to 10 groups of fibers per foil dipole member are used. Upon completion of the coil, a radial tie wrap is applied around the outside diameter to keep it restrained until it can be placed into a payload. During the procedure, ambient temperature should be 60° F. to 85° F. and humidity should be 50%±5%.

The fiber under foil chaff device fabrication may be done manually. However, semi-automation of the foil and fiber preparation and coiling is preferred. FIG. 4 shows a diagram of a semi-automatic spool assembly wrapping machine for carrying out the fabrication procedure. The machine includes a fiber cutter/presenter 30, a foil cutter/crimper 40, and a coiling head 50. The fiber cutter/presenter 30 has spools 32 of fiber mounted thereof. A motor driven cutter 34 presents fiber in predetermined lengths. Fiber from each spool is pulled to a cutting head 36 by a motor driven mechanism 38. Similarly, a foil strip on a coil 42 is advanced to a cutting head 44. The cut lengths of foil are then placed in a crimping mechanism 46. The prepared fiber and foil members are manually transferred to the coiling head 50. The operator should wear nylon gloves and use a grounded wrist strap.

Referring to FIG. 5, a rotatable coiling ring 52 receives the manually transferred foil members, a series of spaced-apart, tensioned-finger mechanisms 54 holds the coiled foil members in place. As each overlapped foil member is transferred and placed, the coiling ring is rotated to pull the foil member under the lead finger. The fingers maintain the coil as fabrication of the chaff device proceeds.

The foregoing description of the invention has been directed to a particular preferred embodiment for purposes of explanation and illustration. It will be apparent, however, to those skilled in this art that many modifications and changes in the apparatus may be made without departing from the essence of the invention. It is the Applicant's intention in the following claims to cover all equivalent modifications and variations as fall within the scope of the invention.

What is claimed is:

1. A chaff device deployable under exoatmospheric conditions to dispense individual dipoles in a cloud, comprising:

a plurality of elongated foil members, each for providing a dipole; and a plurality of elongated fiber members, each for providing a dipole; and said foil dipole members being disposed in an end-to-end overlapping relationship and wrapped in a coil configuration;

said fiber dipole members being separated into a plurality of groups, each group of fiber dipole members being disposed adjacent one of said foil dipole members so as to be sandwiched between adjacent layers of coil wrapped foil dipole members.

2. The chaff device of claim 1 wherein said foil dipole members have length and width dimensions greater than the length and width dimensions of the fiber dipole members.

3. The chaff device of claim 2 wherein the fiber dipole members of each group are placed in parallel and laterally spaced-apart from one another.

4. The chaff device of claim 3 wherein the fiber dipole members of each group are in a longitudinal, stagger placement.

5. The chaff device of claim 4 wherein each foil dipole member has a longitudinal crimp.

6. The chaff device of claim 1 wherein the fiber members are of a material composition selected from a group consisting of: aluminized glass, glass covered copper, or nickel covered-copper covered glass.

7. A method of producing a chaff device, comprising the steps of:

(a) providing a plurality of elongated foil members;

(b) providing a plurality of elongated fiber members;

(c) sequentially placing said foil members in an overlapped, end-to-end arrangement and wrapping them in a coil configuration; and (d) placing a group of said fiber members adjacent each of said foil members as the foil members are being placed and wrapped, such that the fiber members become sandwiched between adjacent layers of the coil wrapped foil dipole members.

* * * * *